US006132258A

United States Patent [19]

Kajinuma

[11] Patent Number: 6,132,258

[45] Date of Patent: Oct. 17, 2000

[54] BOARD TO BOARD ELECTRICAL CONNECTOR

[75] Inventor: Shuji Kajinuma, Yamato, Japan

[73] Assignee: The Whitaker Corporation, Wilmington, Del.

[21] Appl. No.: 09/214,030

[22] PCT Filed: Jul. 30, 1997

[86] PCT No.: PCT/US97/13416

§ 371 Date: Dec. 23, 1998

§ 102(e) Date: Dec. 23, 1998

[87] PCT Pub. No.: WO98/05103

PCT Pub. Date: Feb. 5, 1998

[30] Foreign Application Priority Data

Jul. 31, 1996 [JP] Japan ..... 8-202028

[51] Int. Cl.[7] ..... H01R 24/00; H01R 33/00

[52] U.S. Cl. ..... 439/660; 439/108; 439/74

[58] Field of Search ..... 439/660, 74, 108, 439/79, 676, 83

[56] References Cited

U.S. PATENT DOCUMENTS

| | | | |
|---|---|---|---|
| 5,183,405 | 2/1993 | Elicker et al. | 439/108 |
| 5,356,300 | 10/1994 | Costello et al. | 439/101 |
| 5,688,130 | 11/1997 | Huang | 439/79 |
| 5,746,622 | 5/1998 | Consoli et al. | 439/521 |
| 5,842,874 | 12/1998 | Yagi et al. | 439/74 |
| 5,915,975 | 6/1999 | McGrath | 439/74 |
| 5,971,800 | 10/1999 | Azuma et al. | 439/502 |
| 6,024,582 | 2/2000 | Wu | 439/74 |
| 6,048,221 | 4/2000 | McCleerey et al. | 439/326 |

FOREIGN PATENT DOCUMENTS

| | | | |
|---|---|---|---|
| 0717463 A2 | 6/1996 | European Pat. Off. | H01R 9/09 |
| 7-240246 | 12/1995 | Japan | H01R 9/09 |

OTHER PUBLICATIONS

International Search Report in priority PCT/US97/13416, three pages Apr. 1998.

*Primary Examiner*—Brian Sircus
*Assistant Examiner*—Michael C. Zarroli
*Attorney, Agent, or Firm*—Michael Aronoff

[57] ABSTRACT

In a connector assembly for mounting on printed circuit boards and consisting of a receptacle connector (10) and a plug connector (20), the plug-side board mount (26) has a contact tab (26*c*), and the receptacle-side board mount (16) has a spring arm contact section (16*c*) that engages the contact tab (26*c*) of the plug-side board mount (26) when the connectors are mated. The spring arm contact section (16*c*) is disposed within a vertical through-cavity (12*b*) of the receptacle connector (10). When the connectors are mated, the spring arm contact section (16*c*) located in the through-cavity (12*b*) of the receptacle connector fits into the through-cavity (22*b*) of the plug connector where it engages with the contact tab (26*c*).

4 Claims, 5 Drawing Sheets

BOARD TO BOARD ELECTRICAL CONNECTOR

FIELD OF THE INVENTION

This invention relates to electrical connectors, specifically to electrical connectors that are mounted on printed circuit boards.

BACKGROUND OF THE INVENTION

Electrical connectors consisting of two halves mounted on nearly parallel printed circuit boards to be connected together, are known in the art. Following the general trend toward the reduction of electrical devices in size, such connectors intended for the mounting on printed circuit boards are also becoming smaller resulting in the necessity to increase strength of the mechanical connection of such connectors to boards. For this purpose, the board mounted connectors are secured to the boards by solder mounts set in side walls of the housing, for example, and surface mounted to the board surface such as in connectors according to Japanese Patent Disclosure Hei 7 (1995)-240246. Another method of securing the solder mounts to the connector consists in the embedding of grounding contacts in side walls of the housing such as in connectors according to Japanese Patent Disclosure Hei 7 (1995)-94241.

In order to enhance the freedom of designers of such small-size connectors intended for the mounting on board surface, it is desirable to provide an electrical connection between the solder mount of the plug connector and that of the receptacle connector for the purposes of grounding. That is, it is desirable to provide a possibility to ground connectors through solder mounts of either plug or receptacle connectors.

It is known from U.S. Pat. No. 5,183,405 for a matable connector pair to have housings with board mounts having contact sections disposed in cavities for grounding continuity, where one contact of a mating pair has a tab and the other has a spring arm contact section within its cavity to mate with the tab, with the mating tab adjacent a housing sidewall and the spring arm deflectable within its housing by the mating tab.

The purpose of this invention is to offer a board surface mounted connector allowing for the implementation of grounding either from the plug connector side or from the receptacle connector side by providing electrical connection between both solder mounts without compromising the small size of the connector.

SUMMARY OF THE INVENTION

The electrical connector according to this invention consists of two matching halves with the board mounts of a first half of the connector having contact tabs and the board mounts of the second half having spring arm contact sections that produce a contact with the contact tabs of the first half when the connector halves are joined together, and in one aspect it is characterized by the spring arm contact sections being arranged in such a manner that they can deflect inside through-cavities made in the vertical direction inside the housings of the matching half each of connector.

It is desirable to form support surfaces in open spaces provided for the spring arm contact sections.

It is also desirable to provide the spring arm contact sections with a guiding surface that would initiate deflection thereof to the contacting position upon mating of the complementary connectors.

An embodiment of the invention will now be described by way of example with reference to the accompanying drawings, in which:

DETAILED DESCRIPTION

Figure 1:
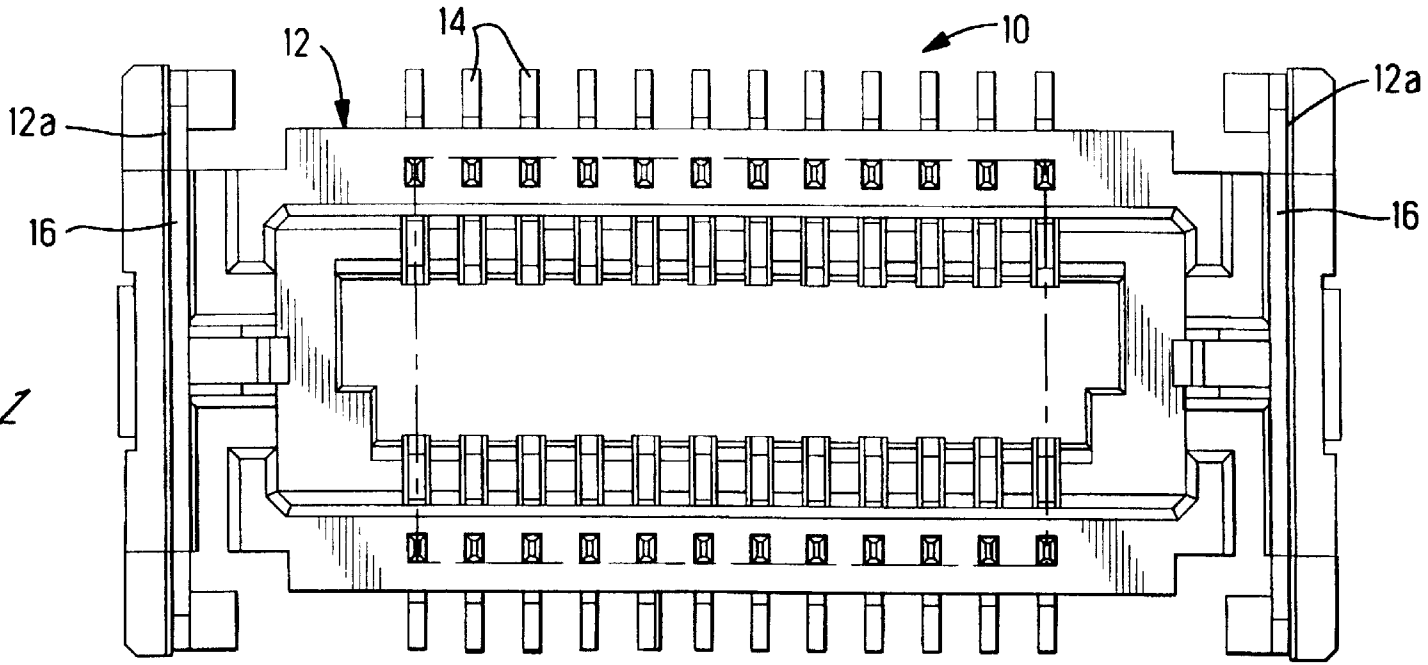
FIGS. 1 to 3 are plan, front and side views of the receptacle assembly of an embodiment of the electrical connector according to this invention.
Figure 2:
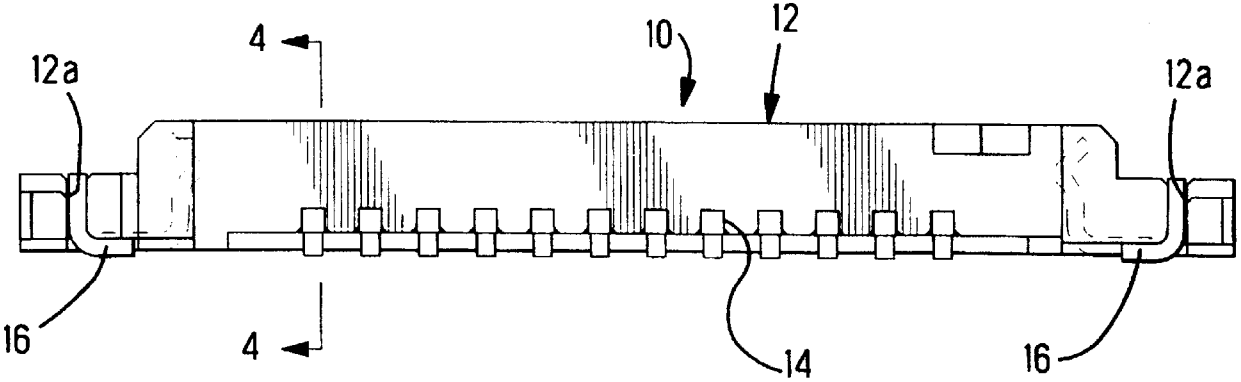
Figure 4:
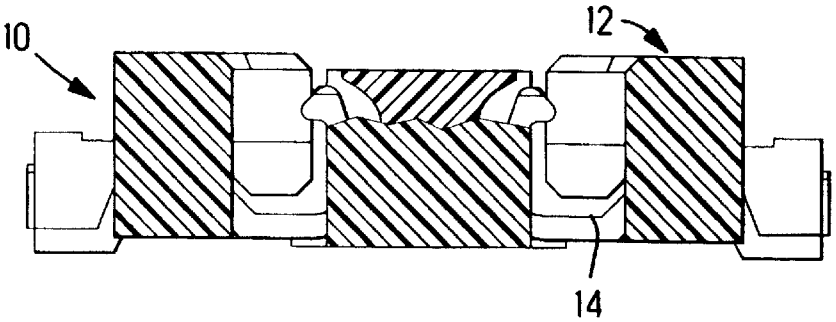
FIG. 4 is a cross section of said receptacle assembly through lines 4—4 in FIG. 2.
Figure 3:
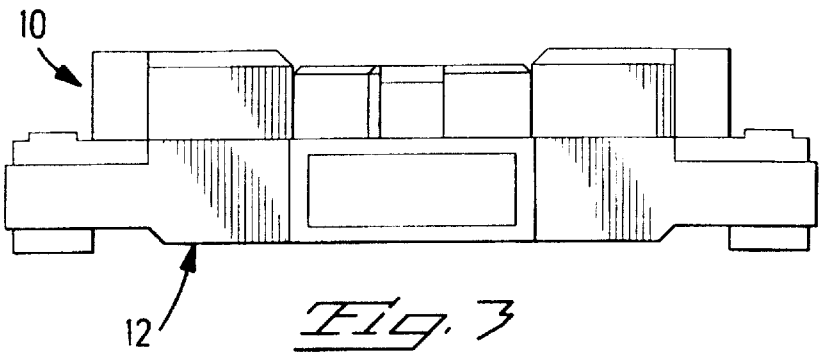
Figure 5:
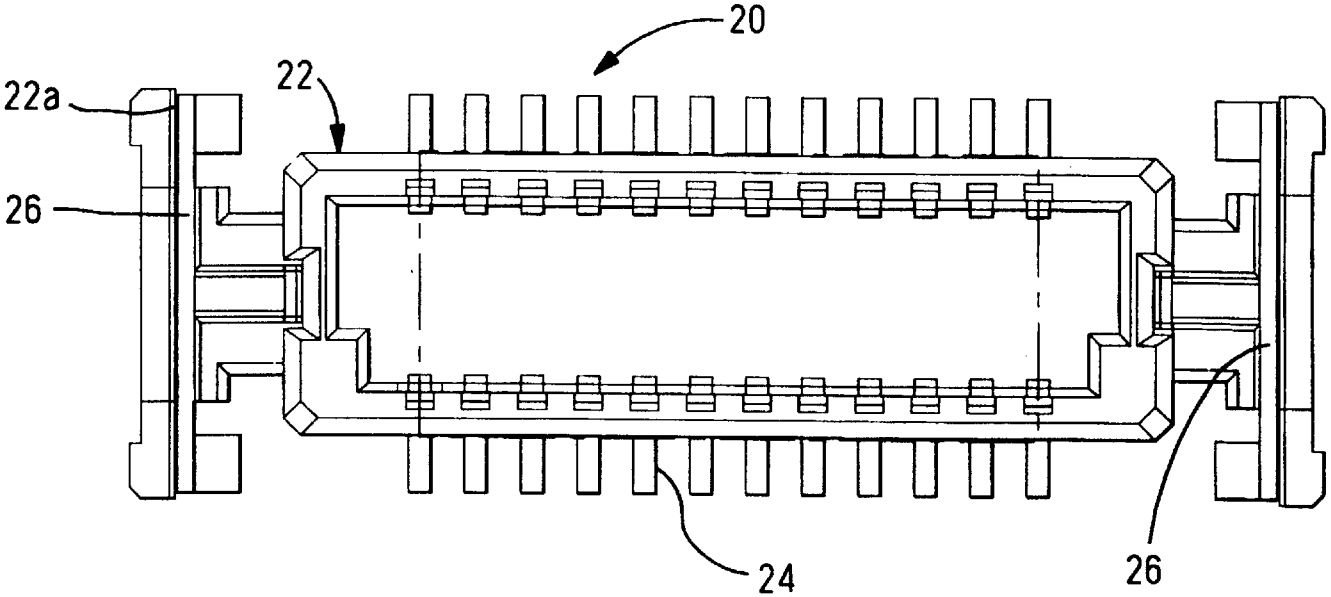
FIGS. 5 to 7 are plan, front and side views of the plug assembly of an embodiment of the electrical connector according to this invention.
Figure 6:
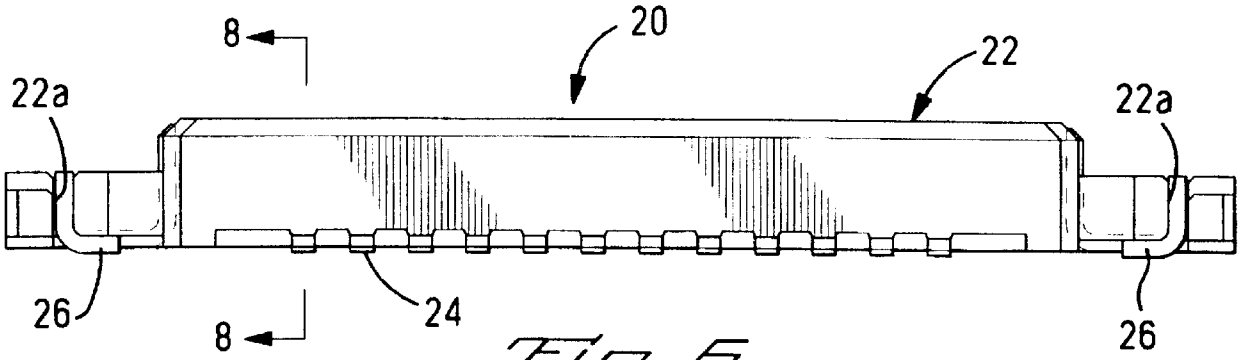
Figure 8:
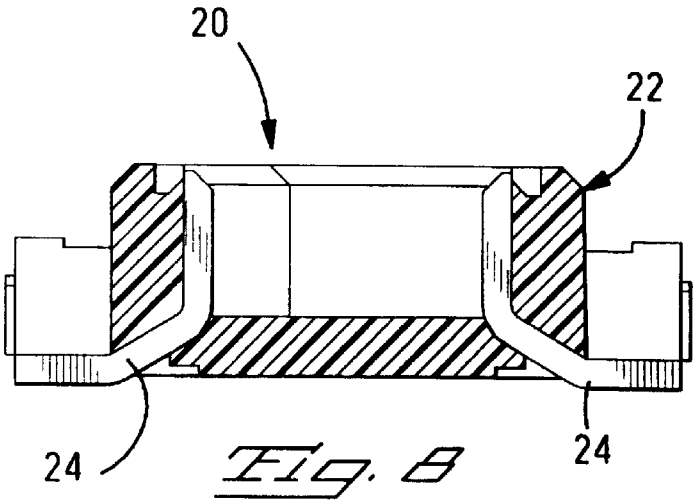
FIG. 8 is a cross section of said plug assembly through lines 8—8 in FIG. 6.
Figure 7:
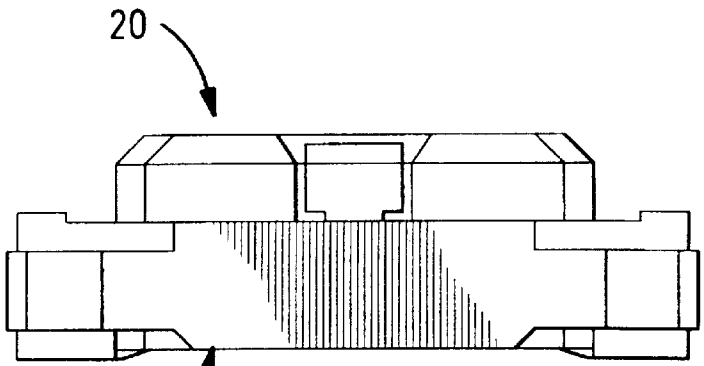

The specific configuration of a solder mount of the receptacle connector can be implemented as a bridge section, that fits in a groove made in the housing and supports the entire mount body, having mounting wings intended for soldering formed at the both ends of the bridge section, a spring arm contact section of U-shaped cross section formed at the middle of the bridge section, and a pair of press-in tongues formed between said spring arm contact section and the mounting wings. A specific configuration of the mount of the plug connector can be implemented as a bridge section, that fits in a groove made in the housing and supports the entire mount body, having mounting wings intended for soldering formed at the both ends of the bridge section, a contact tab of U-shaped cross section formed at the middle of the bridge section, and a pair of press-in tongues formed between the contact tab and the mounting wings.

In this electrical connector, the solder mount of the first half of the connector has contact tabs while the solder mount of the second half of the connector has spring arm contact sections that engage the contact tabs when the halves are joined together. Due to the fact that said spring arm contact sections fit into and can deflect inside vertical through-cavities made in the housing of the second half of the connector, the overall dimensions of the connector can be reduced, and since the grounding connection can be made through a solder mount of either the plug or the receptacle connector, the connectors can be designed with fewer limitations.

The inclined surface formed in the vertical through-cavity supports the spring arm contact section preventing plastic deformation. Due to the fact that the contact tab has a chamfered guiding surface that initiates deflection of the spring arm contact section at the time of joining the connectors to the contacting position, the transition of the contact tab and the spring arm contact section to the mutually connected state takes place very smoothly.

As it can be seen from FIGS. 1 through 4, a plurality of contacts 14 are arranged in the housing 10 of the receptacle connector assembly 10 (below, simply "receptacle assembly"), and two solder mounts 16,16 are secured in the retaining grooves 12*a*,12*a* formed in both ends of the housing 12.

Figure 9:
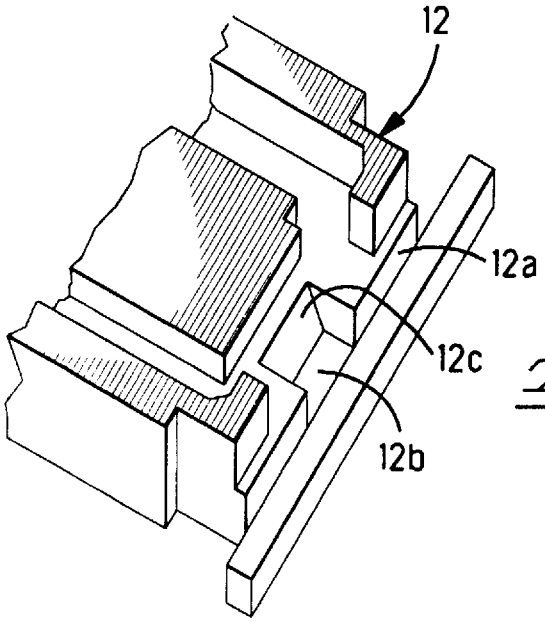
FIGS. 9 and 10 are partial oblique views of the receptacle and plug assemblies, respectively.

FIG. 9 represents an enlarged view of the solder mount retaining groove 12*a* and the through-cavity 12*b* in which the solder mount 16 is secured, formed in the end of the housing 12 of the receptacle assembly 10. The solder mount 16 is inserted and secured in the solder mount retaining groove 12*a* and the through-cavity 12*b* as it will be explained in more detail below.

As it can be seen from FIGS. 5 through 8, a plurality of contacts 24 are arranged in the housing 22 of the plug connector assembly 20 (below, simply "plug assembly"), and two solder mounts 26,26 are secured in the retaining grooves 22*a*,22*a* formed in both ends of the housing 22.

Figure 10:
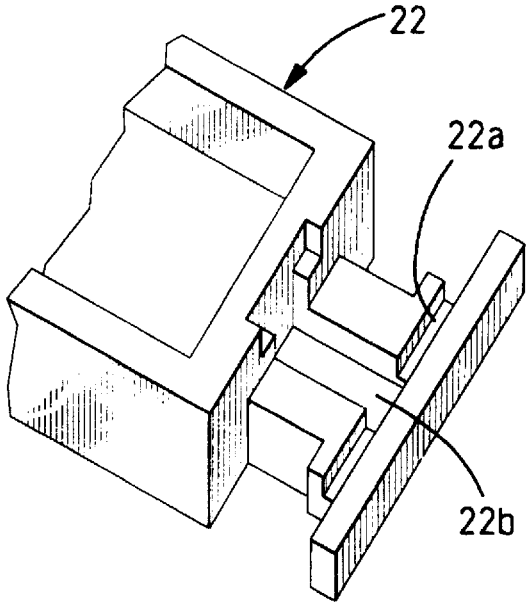

FIG. 10 represents an enlarged view of the solder mount retaining groove 22*a* and the through-cavity 22*b* in which the solder mount 16 is secured, formed in the end of the housing 22 of the plug assembly 20. The solder mount 26 is inserted and secured in the solder mount retaining groove 22*a* and the through-cavity 22*b* as it will be explained in more detail below.

Figure 11:
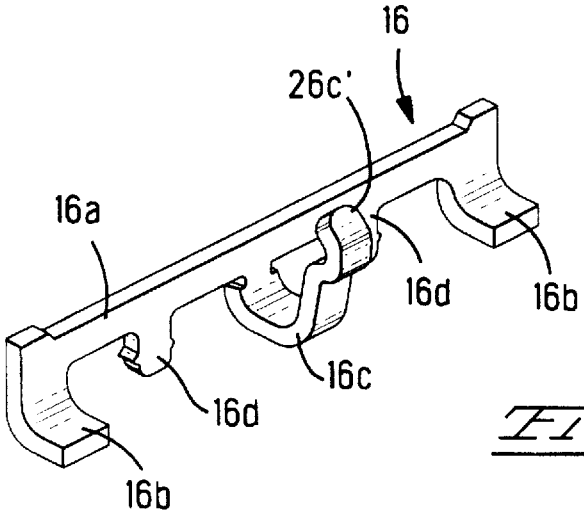
FIG. 11 is an oblique view of the solder mount having a spring arm contact section intended for the receptacle assembly.
Figure 12:
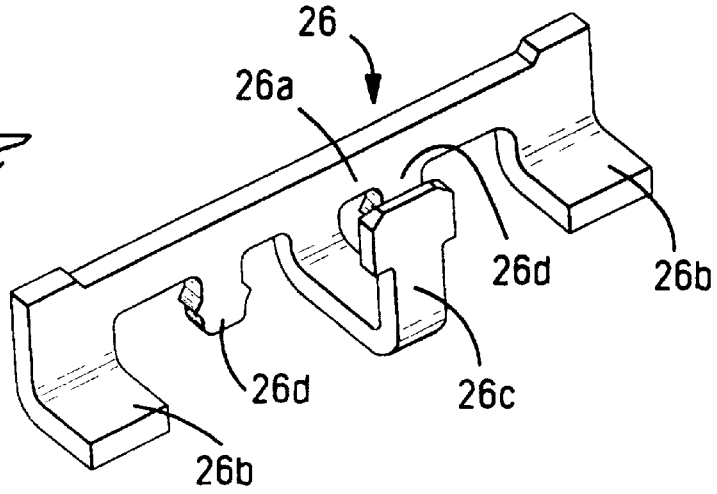
FIG. 12 is an oblique view of the solder mount having a contact tab intended for the plug assembly.
Figure 13:
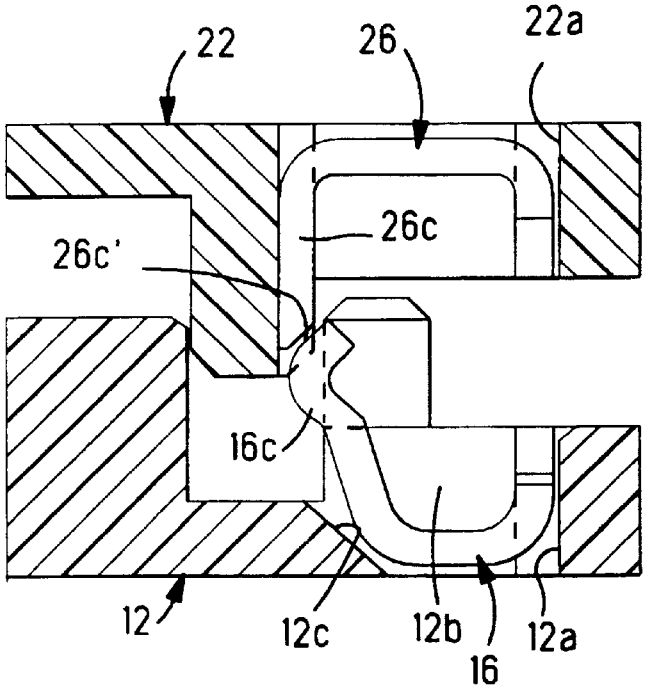
FIGS. 13 and 14 are enlarged views of the spring arm contact section and contact tab before and after they engage each other when receptacle assembly and plug assembly are mated.
Figure 14:
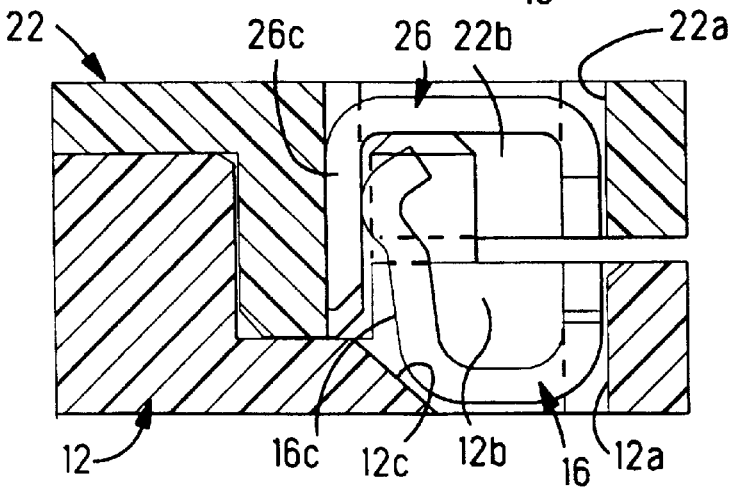

FIG. 11 is an enlarged view depicting a solder mount 16 of the receptacle connector and FIG. 12 is an enlarged view depicting a solder mount 26 of the plug connector. FIGS. 13 and 14 represent an enlarged view of mutual position of the solder mount 16 of the receptacle connector and the solder mount 26 of the plug connector when the receptacle assembly 10 and plug assembly 20 are joined together.

As it can be seen from FIG. 11, the receptacle-side solder mount 16 consists of a bridge 16*a* that fits in the groove 12*a* of the housing 12, mounting wings 16*b*, 16*b* provided for soldering to the board at both ends of the bridge, a spring arm contact section 16*c* of U-shaped cross section formed at the middle of bridge 16*a*, and a pair of press-in tongues 16*d*,16*d* formed between said spring arm contact section 16*c* and mounting wings 16*b*,16*b*. The plug-side solder mount 26 consists of a bridge 26*a* that fits in the groove 22*a* of the housing 22, mounting wings 26*b*,26*b* provided for soldering to the board at both ends of the bridge, a contact tab 26*c* of U-shaped cross section formed at the middle of bridge 26*a*, and a pair of press-in tongues 26*d*,26*d* formed between contact tab 26*c* and mounting wings 26*b*,26*b*.

The press-in tongues 16*d*,16*d* of the receptacle-side solder mount 16 shown in FIG. 11 are inserted and pressed in the groove 12*a* of the housing 12 shown in FIG. 9; at that time, the spring arm contact section 16*c* fits in through-cavity 12*b* of housing 12 where it can be deflected.

The press-in tongues 26*d*,26*d* of the plug-side solder mount 26 shown in FIG. 12 are inserted and pressed in the groove 22*a* of the housing 22 shown in FIG. 10; at that time, contact tab 26*c* fits in through-cavity 22*b* of the housing 22.

When the housings 12 and 22 are joined together as shown in FIG. 13, the spring arm contact section 16*c* of the receptacle-side solder mount 16 comes in contact with the contact tab 26*c* of the plug-side solder mount 26 and it is deflected inside as shown in FIG. 14; when the state of full contact with the contact tab 26*c* of the plug-side solder mount 26 is achieved, it is inserted in through-cavity 22*b* of the housing 22 of the plug-side assembly. Since the spring arm contact section 16*c* of the receptacle-side solder mount 16 is located inside through-cavity 12*b* of receptacle-side housing 12 (after connector mating is completed, it is located also inside the through-cavity 22*b* of the housing 22 of the plug-side assembly), the overall height of the connector can be made smaller. Due to the fact that both solder mounts 16 and 26 are in contact with each other, the grounding connection to the circuit board can be made by the solder mount of either plug-side or receptacle-side connector, thus providing for a greater freedom in the designing process.

In addition, the purpose of the inclined surface 12*c* formed in through-cavity 12*b*, against which the spring arm contact section 16*c* bears, is to support section 16*c* and prevent plastic deformation thereof resulting from repetitive connections and disconnections of the connector. Due to the fact that the spring arm contact section 16*c* has a guiding surface 26*c*' that directs the contact tab 26*c* at the time of joining the connector halves to the contacting position, the transition of the spring arm contact section 16*c* and the contact tab 26*c* to the mutually connected state takes place very smoothly.

The embodiment explained above is only one example of the ideas that form the basis of the design of the electrical connector according to this invention. For example, the receptacle-side solder mount 16*c* and the plug-side solder mount 26*c* can be interchanged with each other. Configurations of connector housing, solder mounts, etc. also can be modified if such modifications do not affect the substance of the invention.

What is claimed is:

1. An electrical connector assembly, whose purpose is to join two nearly parallel printed circuit boards, consisting of two complementary connector halves that are secured to opposing surfaces of said printed circuit boards by board mounts secured within cavities of housings of said connector halves, said board mounts of one said connector half have contact tabs and said board mounts of the other said connector half have spring arm contact sections that engage with said contact tabs of said one half when said connector halves are mated, characterized in that:

said cavities have portions that extend through the housings, with said tabs and said spring arm contact sections disposed in respective said through cavity portions, and said spring arm contact sections are arranged in such a manner that they can deflect inside said through cavities inside said housings, and wherein each said through cavity portion containing a said spring arm contact section includes a support surface engageable therewith during connector mating to prevent plastic deformation of said spring arm contact section.

2. The connector assembly as set forth in claim 1 wherein each said spring arm contact section includes an angled guiding surface at its leading end engageable with a said contact tab to initiate deflection thereof.

3. The connector assembly as set forth in claim 1 wherein a leading end of each said spring arm contact section enters said through cavity portion of said housing of said one connector to engage said contact tab therein and be deflected therein.

4. An electrical connector assembly for joining two nearly parallel printed circuit boards, the connector assembly comprising:

two complementary connector halves that are securable to opposing surfaces of one of the printed circuit boards, each half comprising a mating face;

an opposing board mounting face;

a cavity extending from the mating face to mounting face;

a board mount secured within the cavity, wherein the board mount of one said connector half includes a contact tab disposed in the cavity and the board mount of the other said connector half includes a spring arm contact section disposed in the cavity, and the spring arm contact section engages with the contact tab and deflects through both cavities when said connector halves are mated.

* * * * *